United States Patent [19]

Donahue et al.

[11] Patent Number: 4,875,985

[45] Date of Patent: Oct. 24, 1989

[54] METHOD AND APPPARATUS FOR PRODUCING TITANIUM

[75] Inventors: Raymond J. Donahue, Fond du Lac; William G. Hesterberg, Rosendale; Terrance M. Cleary, Allenton, all of Wis.

[73] Assignee: Brunswick Corporation, Skokie, Ill.

[21] Appl. No.: 258,035

[22] Filed: Oct. 14, 1988

[51] Int. Cl.[4] ..... C25C 3/28

[52] U.S. Cl. ..... 204/64 T; 204/140; 204/241; 204/246

[58] Field of Search ..... 204/64 T, 130, 140, 204/241, 246, 243 R–245, 247

[56] References Cited

U.S. PATENT DOCUMENTS

| | | | |
|---|---|---|---|
| 2,760,858 | 8/1956 | Findlay et al. | 204/64 T X |
| 2,848,395 | 8/1958 | Carignan | 204/246 X |
| 2,887,443 | 5/1959 | Blue et al. | 204/64 T |
| 2,917,440 | 12/1959 | Olson | 204/64 T |
| 2,958,640 | 11/1960 | Cichelli | 204/246 |
| 3,203,883 | 8/1965 | Ototani et al. | 204/140 |

FOREIGN PATENT DOCUMENTS

| | | | |
|---|---|---|---|
| 2039387 | 2/1971 | Fed. Rep. of Germany | 204/64 T |

*Primary Examiner*—Donald R. Valentine
*Attorney, Agent, or Firm*—Andrus, Sceales, Starke & Sawall

[57] ABSTRACT

A method of producing titanium. A quantity of titanium is heated in a crucible to provide a melt, and a layer of slag, containing an ionizable titanium compound, such as titanium dioxide, along with ionizable slag constituents, is disposed on the top of the melt. The slag is then heated to a molten state by direct current plasma arc heating with the melt being anodic. After the slag is molten, the polarity of the plasma arc heating is reversed so that the melt is cathodic, causing the slag to act as an electron transfer layer so that the titanium dioxide of the slag is reduced to titanium and any dissolved oxygen in the melt is converted to an ionic species of oxygen at the interface between the slag and the melt. The resulting liquid titanium is combined with the melt, while the ionic species of oxygen is carried upwardly through the slag and released from the slag layer by an oxidation process. Additional quantities of titanium dioxide can be added to the slag to continually convert the titanium dioxide to titanium under the reverse polarity plasma arc heating.

27 Claims, 1 Drawing Sheet

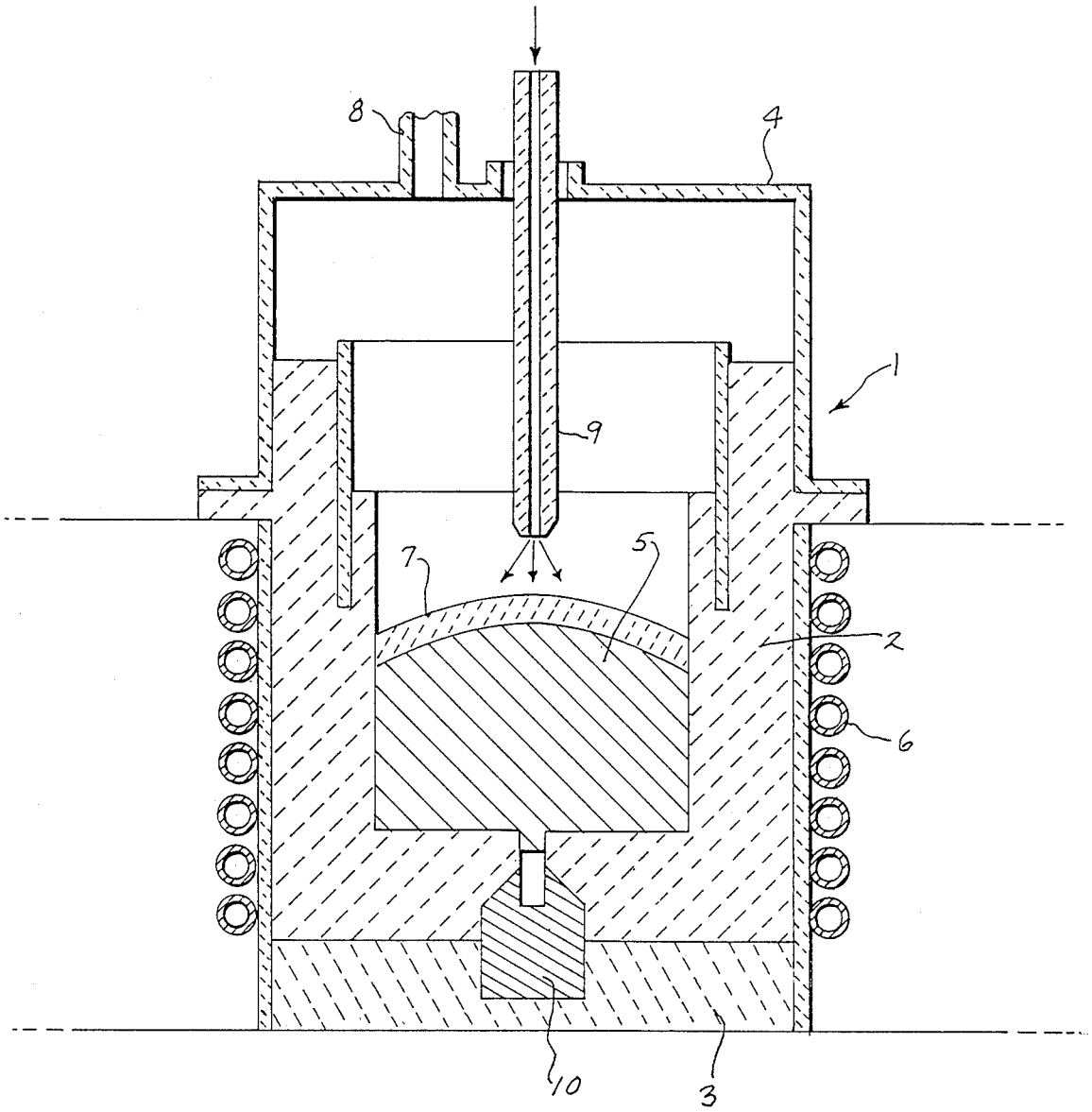
8
4
1
9
7
5
2
6
10
3

METHOD AND APPPARATUS FOR PRODUCING TITANIUM

BACKGROUND OF THE INVENTION

Cylinder blocks and other components of marine engines are commonly formed of aluminum alloys because of their high strength-to-weight ratio and corrosion resistance. It would be desirable to fabricate marine engines or engine components of titanium because of the high mechanical properties of titanium and its corrosion resistance. However, titanium is considerably more expensive than aluminum alloys due to difficulties in extracting titanium from its ore. In addition, commercially available titanium contains small residual amounts of oxygen which cannot be removed by conventional extraction processes. Because of this, the use of titanium for marine engines and engine components has not been commercially feasible.

Processes are known for refining pure iron by direct current arc heating. In processes of this type, as described in U.S. Pat. No. 3,203,883, iron containing impurities, such as sulfur and oxygen, is melted in a crucible, and a slag layer, composed of calcium silicate and containing an alkali metal, alkaline earth metal, iron, or aluminum compound, is disposed on the upper surface of the molten iron and heated to a molten state. After the slag has been melted, a D.C. voltage is applied between an anode that is suspended above the slag layer and the cathodic molten metal and the slag then acts as an electron transfer layer, so that impurities, such as sulfur and oxygen, are carried into the slag and oxidized at the upper face of the slag layer to sulfur dioxide and oxygen that is evolved from the melt. At the temperatures involved, the major portion of the oxides of the slag, such as calcium oxide, and are not reduced or effected by the arc heating.

SUMMARY OF THE INVENTION

The invention is directed to an improved and economical process for producing titanium from titanium dioxide. In accordance with the invention, a quantity of pure titanium, or titanium containing an amount of oxygen up to about 2.0% by weight, is heated preferably by induction heating in a crucible to provide a melt. A layer of slag containing a substantial amount of an ionizable titanium compound, such as titanium dioxide or its lower oxides, along with other ionizable slag constitutents, such as alkali metal and alkaline earth metal oxides, aluminates, and fluorides, is then disposed on the upper surface of the melt and the slag is then heated to a molten state by a direct current plasma arc heating process with the melt being anodic.

After the slag has been melted, the polarity of the plasma arc heating is reversed, so that the melt is cathodic, thereby causing the titanium dioxide of the slag to be reduced directly or in stages to titanium at the interface between the slag and the melt and the resulting pure titanium is carried into the melt, while, to conserve charge neutrality, the ionic species of oxygen at the upper surface of the slag is subsequently oxidized to a gaseous molecular species of oxygen as the ionic species of oxygen leaves the slag. That part of the Faradaic current not used to reduce the oxides of titanium can be used to reduce the oxygen dissolved in the titanium melt metal at the slag/metal interface. Thus, the tightly held dissolved oxygen in the melt can be carried upwardly into the slag by a reduction process, independent of the titanium reduction, and can be discharged from the slag to the plasma phase by an oxidation process, which like the titanium reduction electrochemical reaction can be influenced by a controlled atmosphere above the slag. The details of the interfaces between the metal/slag and the slag/plasma are of great interest, although not well understood structurally, because the electrochemical reactions occur in these regions. When electrochemical reactions occur, there is a change in charge carriers from electrons to ions. As a result, in both of the slag interface regions, a non-uniform distribution of charge can be present due to a layer of absorbed ions; however, the charge neutrality principle must exist across the slag (i.e. charge may not accumulate in the slag). It is advantageous for a high operating efficiency of this electrochemical invention that power losses ("IR drop") associated with the slag be kept to a minimum. Thus high ionic mobility of the titanium species is of primary importance.

By adding quantities of titanium dioxide to the slag, the titanium dioxide will be continually converted to pure titanium.

The invention provides an economical method of producing pure titanium through use of a reverse polarity direct current plasma arc heating process. The titanium produced from the method of the invention has wide application of use and has particular utility in producing exhaust elbows and manifolds, connecting rods, cylinder blocks, or other components for marine engines.

Other objects and advantages will appear in the course of the following description.

DESCRIPTION OF THE DRAWING

The drawing illustrates the best mode presently contemplated of carrying out the invention.

The drawing is a schematic representation of an apparatus to be used in carrying out the method of the invention.

DESCRIPTION OF THE ILLUSTRATED EMBODIMENT

The drawing shows a closed crucible 1 that can be used in carrying out the method of the invention. Crucible 1 is provided with refractory side walls 2 and bottom wall 3 and a closed top 4. A quantity of substantially pure titanium 5 is heated in crucible 1 to provide a melt. The titanium can be pure or can contain a small residual amount of oxygen up to about 2.0% by weight.

The titanium 5 is heated in the crucible to a temperature above its melting point, i.e. 1725° C., preferably by an induction heating coil 6 which surrounds the side walls 2 of crucible 1.

To minimize oxidation of the titanium, during the heating, an inert or reducing gas, such as hydrogen or aluminum vapor, can be introduced into the closed crucible 1, through a conduit, not shown. Alternately, conventional vacuum melting procedures can be used.

After the titanium is in the molten state, the slag constituents are introduced through an inlet 8 into the crucible onto the upper surface of the molten titanium 5. The slag layer 7 comprises a substantial quantity of titanium dioxide or its lower oxides such as $Ti_3O_5$, $Ti_2O_3$ and TiO along with ingredients that enhance the conductivity and viscosity of the slag. For example, these ingredients can take the form of alkali metal oxides, such as sodium, potassium or lithium oxide, alkaline earth metal oxides, such as barium, calcium or strontium oxides, acid oxides such as aluminum oxide and alkali metal and alkaline earth metal fluorides. The fluorides and aluminates are not technically needed but aid in the practical application of the invention by providing lower temperature slag melts. Also alkali titanium fluoride salts can dissolve $TiO_2$. Chloride salts, even if they dissolve $TiO_2$ or provide lower temperature slag melts, have too high a vapor pressure at the temperatures involved. Silicates are not recommended as slag components, because silicon can be reduced from the slag, and thus contaminates the titanium. For similar free energy considerations, potassium, sodium, lithium, barium, strontium, and calcium are not reduced from the slag oxides that contain the respective cations.

It has been found that in the refining of titanium dioxide, the use of sodium, potassium, lithium, barium and strontium oxides have advantages over calcium oxide as used in the past in ferrous refining processes. The above named oxides have a lower ion-oxygen attraction between constituents as compared to calcium oxide, and the silicates of the above oxides have a larger negative heat of formation than calcium silicate. Moreover, the above oxides have a lower activation energy for ionic conduction and higher ionic character of bond than calcium oxide.

The slag 7 is then heated to a temperature sufficient to melt the slag by direct current plasma arc heating, in which the melt 5 is the anode. In general, the slag is heated to a temperature above the melting point of titanium i.e. 1725° C., and generally in the range of about 1850° C. to 2000° C. to provide a molten slag layer.

The plasma arc heating is a conventional process and can be similar to that described in Ph.D. Thesis, "Plasma Refining of Molten Steel" by Frank L. Kemeny (1987), University of Toronto. In general, the plasma arc heating includes a hollow graphite electrode 9 which extends downwardly through the top 4 of crucible 1, with the lower end of the electrode 9 being located slightly above the slag layer 7. Argon gas is directed through the hollow electrode 9 to create a singlely charged ion species of the plasma. If sodium chloride in a finely divided form is introduced into the argon stream a lower voltage (i.e. volts/in) results between the anode electrode and the slag, thus permitting lower power consumption and more economical production of titanium. In addition, a water cooled copper electrode 10 is embedded in the bottom wall 3 of the crucible, as shown in the drawing. During the initial heating to melt the slag layer, the melt is anodic.

After the slag 7 has been melted, the polarity is reversed, so that the melt 5 is then cathodic. Under these reverse polarity conditions, the slag layer 7 acts as an electrochemical electron transfer layer, unlike the chemical "sink" function of conventional steel refining slags, with the interface between the slag 7 and melt 5 being a reducing zone and the upper face of the slag layer being an oxidation zone. Accordingly, the titanium dioxide of the molten slag will be reduced to titanium at the lower interface and oxygen in the melt will be carried upwardly through the slag layer and rejected from the slag by an oxidation process at the upper slag/-plasma interface. The titanium being generated by the reverse polarity will be substantially pure liquid titanium.

The atmosphere in the crucible above the slag layer can be made to react with the species produced by the plasma/slag interface to prevent that interface from becoming rate controlling for titanium refining by use of vacuum or through use of a gas that reacts with oxygen, such as hydrogen, or a metallic vapor, such as lithium, potassium, sodium or aluminum vapor. However, during the process when the melt is cathodic, the electron flow allows the process to be carried out with an air atmosphere because the energized slag protects the titanium metal. The "energized" cathodic melt conditions that produce an electron flow from metal-to-slag-to-plasma insure that the ionic species of oxygen cannot traverse through the slag in the reverse direction and thus physically insures an air atmosphere above the slag cannot contaminate the titanium beneath the slag. Thus, the electrochemical slag practice of the current invention as applied to titanium is quite different from the "diffusion controlled" protective barriers of conventional chemical slag practices which only mitigate melt contamination.

The process can be continuous by adding additional quantities of titanium dioxide to the slag layer, which will result in the continuous generation of pure titanium.

By introducing the argon gas through the hollow electrode, the arc is stabilized and focused at the center of the crucible, to provide a temperature gradient from the center of the crucible to the wall. As the wall is at a lower temperature, the potential for certain oxides in the slag, such as sodium oxide, to attack the crucible walls is minimized.

In the invention the reduction is accomplished by the electrolysis of a molten slag mixture containing an ionizable titanium compound in solution. At the temperatures involved, a selective reduction of the titanium compound is obtained without reduction of the other metal oxides of the slag. Moreover, the resulting reduced titanium is in a molten form, as opposed to a finely divided solid form that is obtained in conventional electrolytic processes, in which the titanium would be difficult to remove from the original titanium compound. As the anodic electrode and the liquid cathodic metal are separated by a plasma phase and a liquid slag phase, the liquid titanium reduction production and the starting reaction oxide constituents are inherently favorably positioned for separation.

The slag layer has charged neutrality, meaning that for every electron used at the melt/slag interface for the reduction reaction, the same number of electrons are used in the oxidation reaction at the slag/plasma interface. The oxidation reaction at the slag/plasma interface should not be rate controlling and the metal oxide slag constituents provide a relatively high concentration of the ionic species of oxygen for the oxidation reaction so that the reduction reaction in producing titanium at the melt/slag interface will be rate controlling. If the melt is free of oxygen, the ionic species of oxygen will not be formed at the melt/slag interface and the titanium reduction reaction will be more efficient because the complete electron current can be employed for the titanium reduction.

The invention thus provides a convenient and economical method of producing pure titanium. It is also contemplated that the invention, instead of being used to produce titanium from titanium dioxide or titanium oxide, can be used to refine and remove impurities, such as oxygen, from titanium. In this latter case, the slag layer would not include an ionizable titanium compound.

Various modes of carrying out the invention are contemplated as being within the scope of the following claims particularly pointing out and distinctly claiming the subject matter which is regarded as the invention.

We claim:

1. A method of producing titanium, comprising the steps of heating a quantity of titanium to a temperature above the melting point thereof to produce a melt, providing a layer of a slag containing an ionized titanium compound and slag constituents on the top of said melt, heating said slag to a molten state by direct current plasma arc heating with said melt being anodic, and reversing the polarity of said plasma arc heating with said melt being cathodic to reduce said titanium compound at the interface between said slag and said melt to produce titanium, said titanium being combined with said melt.

2. The method of claim 1, wherein said melt contains dissolved oxygen and said step of reversing the polarity reduces said dissolved oxygen to an ionic species of oxygen.

3. The method of claim 2, and including the step of passing said ionic species of oxygen upwardly through the slag and combining said ionic species of oxygen at the upper face of said slag by an oxidation reaction.

4. The method of claim 3, and including the step of controlling the atmosphere above the slag to influence the oxidation reaction at the upper face of said slag.

5. The method of claim 4, wherein the step of controlling the atmosphere comprises contacting the upper surface of the slag with a gas that reacts with the oxygen produced at the plasma/slag interface.

6. The method of claim 5, wherein the step of contacting the upper surface of the slag with a gas that reacts with oxygen comprises contacting the upper surface with a gas selected from the group consisting of hydrogen and a metal vapor.

7. The method of claim 2, wherein said melt contains up to about 2.0% dissolved oxygen.

8. The method of claim 1, and including the step of adding additional quantities of said ionizable titanium compound to said slag to provide a continuous generation of titanium.

9. The method of claim 1, wherein the step of heating the slag comprises the steps of positioning an electrode in spaced relation above said layer of slag connecting said electrode and said melt in an electric circuit with the melt constituting an anode and the electrode constituting a cathode, and passing a direct current through the circuit with said slag layer constituting an electrolyte.

10. The method of claim 9, wherein the step of reversing the polarity comprises making the melt the cathode in said circuit and making said electrode the anode.

11. The method of claim 10, wherein said electrode includes a longitudinal passage and said method includes the step of passing an ionizable gas through said passage and directing said gas toward said slag layer.

12. The method of claim 11, wherein said ionizable gas is argon.

13. The method of claim 1, wherein said ionizable titanium compound is selected from the group consisting of titanium dioxide and its lower oxides.

14. The method of claim 1, wherein the step of initially heating the titanium comprises induction heating.

15. The method of claim 1, wherein the step of heating the slag comprises heating the slag to a temperature above 1725° C.

16. The method of claim 1, wherein said slag constituents are selected from the group consisting of alkali metal and alkaline earth metal oxides, aluminum oxides, and alkali metal and alkaline earth metal fluorides.

17. The method of claim 1, wherein said slag constituents are selected from the group consisting of sodium oxide, potassium oxide, lithium oxide, barium oxide, strontium oxide and mixtures thereof.

18. A method of producing titanium, comprising the steps of heating a quantity of titanium to a temperature above the melting point thereof to produce a melt, providing a layer of slag containing a substantial quantity of an ionizable titanium compound and containing an ionizable slag constituent on the upper surface of said melt, said titanium compound being selected from the group consisting of titanium dioxide and lower oxides thereof, heating the slag by direct current plasma arc heating with the melt being anodic to a temperature above the melting point of said titanium compound to provide a molten slag layer, reversing the polarity of said plasma arc heating with said melt being cathodic to reduce said titanium compound to produce liquid titanium and convert any dissolved oxygen in said melt to an ionic species of oxygen, and combining the titanium formed by the reduction of said titanium compound with said melt and passing said ionic species of oxygen upwardly through said molten slag layer.

19. The method of claim 18, and including the step of controlling the atmosphere above said slag layer by use of a gas that reacts with oxygen.

20. The method of claim 18, and including the steps of adding additional quantities of said titanium compound to said slag, and continuously converting said titanium dioxide to titanium.

21. A method of producing titanium, comprising the steps of providing a closed crucible, introducing a quantity of titanium into said crucible, heating said titanium in the crucible to a temperature above the melting point thereof to provide a melt, providing a layer of slag containing an ionizable titanium compound on the top of the melt, spacing a first electrode above the upper surface of said molten slag and disposing a second electrode in contact with said melt, connecting said electrodes in an electric circuit, arranging the polarity of the circuit such that said first electrode is cathodic and applying direct current to said circuit to heat the slag to a molten state, reversing the polarity of said circuit with said first electrode being anodic to cause said titanium compound to be reduced to liquid titanium at the interface between said slag and said melt, said liquid titanium being combined with the melt.

22. The method of claim 21, and including the step of exposing the upper surface of the slag layer to a gas that reacts with oxygen.

23. A method of refining titanium, comprising the steps of heating a mass of titanium containing a residual quantity of dissolved oxygen to a temperature above the melting point of said titanium to produce a melt, providing a layer of slag comprising a mixture of ionizable slag constituents on the top of said melt, spacing a first electrode above the upper surface of said slag layer, disposing a second electrode in contact with said melt, connecting said electrodes in an electric circuit, arranging said first electrode as a cathode in said circuit and applying direct current to said circuit to thereby heat said slag to a molten state, arranging the first electrode to be the anode in said circuit and applying said direct current to said circuit to effect deoxidation of said melt.

24. The method of claim 23, wherein said first electrode is hollow and is provided with a longitudinal passage and said method includes the step of passing an ionizable gas through said passage and directing said gas toward the upper surface of said slag layer.

25. The method of claim 24, and including the step of exposing the upper surface of the slag layer to a gas that reacts with oxygen.

26. An apparatus for producing titanium, comprising a closed container to contain a quantity of titanium and a slag layer disposed on top of said titanium, said slag layer including a substantial amount of an ionizable titanium compound and ionizable slag constituents, heating means for heating said titanium to a temperature above the melting point thereof to produce a melt, direct current plasma arc heating means including a first hollow electrode spaced above the upper surface of said melt and a second electrode disposed in contact with said melt, said electrodes being connected in electric circuit, and means for introducing an ionizable gas through the hollow first electrode and directing said gas toward the upper surface of said slag layer, the application of direct current through said circuit with said first electrode being a cathode in said circuit acting to heat said slag to a molten state and application of said direct current to said circuit with said first electrode being an anode in said circuit acting to reduce the titanium compound to liquid titanium at the interface between said slag and said melt, said liquid titanium being combined with the melt.

27. The apparatus of claim 26, and including means for introducing a gas that reacts with oxygen into the container above the level of said slag layer.

* * * * *